United States Patent [19]

Nogami et al.

[11] Patent Number: 4,566,954

[45] Date of Patent: Jan. 28, 1986

[54] METHOD OF AND APPARATUS FOR SPLIT ROLLING OF STEEL SHEET

[75] Inventors: Tadahiko Nogami, Chiyoda; Tadashi Nishino, Hitachi, both of Japan

[73] Assignee: Hitachi, Ltd., Tokyo, Japan

[21] Appl. No.: 448,074

[22] Filed: Dec. 9, 1982

[30] Foreign Application Priority Data

Dec. 9, 1981 [JP] Japan ..... 56-196862

[51] Int. Cl.[4] ..... C25D 7/06; B21B 1/00

[52] U.S. Cl. ..... 204/28; 29/33 S; 29/415; 29/527.4; 72/47; 72/203; 72/234; 204/209

[58] Field of Search ..... 72/203, 204, 221, 222, 72/234, 366, 46, 47; 29/33 S, 33 D, 415, 527.2, 527.4; 204/28, 29, 206, 209

[56] References Cited

U.S. PATENT DOCUMENTS

| | | | |
|---|---|---|---|
| 1,294,501 | 2/1919 | McCormick et al. | 72/203 |
| 2,216,869 | 10/1940 | Yoder et al. | 72/203 X |
| 4,155,238 | 5/1979 | Rogers | 72/204 X |
| 4,193,283 | 3/1980 | Bowman et al. | 72/221 X |

*Primary Examiner*—Lowell A. Larson
*Assistant Examiner*—Steven B. Katz
*Attorney, Agent, or Firm*—Beall Law Offices

[57] ABSTRACT

A method of and apparatus for effecting slitting rolling on a steel sheet, wherein a wide steel sheet is slit in the breadthwise direction into a plurality of steel sheets having smaller width and the slit steel sheets are moved in the breadthwise direction to form and maintain a predetermined distance therebetween. The steel sheets are then rolled independently to have edge drops on both breadthwise ends thereof, and, thereafter, the slit steel sheets having edge drops are subjected to a plating step. According to the invention, it is possible to obtain plated steel sheet product of high quality by slitting rolling.

9 Claims, 13 Drawing Figures

METHOD OF AND APPARATUS FOR SPLIT ROLLING OF STEEL SHEET

BACKGROUND OF THE INVENTION

The present invention relates to a method of effecting a split rolling of steel sheet suitable for slitting a wide steel sheet and rolling the split steel sheets.

Generally, the process for producing a steel sheet has the steps of forming blank slabs from a molten steel by means of a continuous slab casting apparatus, rolling the slab by a hot strip mill down to a thickness of 2 to 6 mm, pickling the rolled steel sheet, further rolling the steel sheet by a cold strip mill down to a thickness of about 0.1 to 2.0 mm and then effecting a surface treatment such as zinc plating on the steel sheet thereby to obtain the desired steel sheet product.

The series of equipment for conducting the above-mentioned steps usually have a capacity large enough to treat steel sheet of a large breadth ranging between 600 and 2000 mm. Actually, however, the equipment is operated to treat comparatively narrow strips of 900 mm wide or so which has the greatest demand, because the blank slab is formed at such a small breadth meeting the demand. This means that the capacity of the equipment, which is large enough to treat steel sheets up to 2000 mm wide, could not be fully utilized.

When the comparatively narrow strips are treated by the equipment which can accommodate strips of large breadth, the guide rolls and rolling rolls of the continuous casting apparatus are locally worn only at the breadthwise portions thereof contacted by the narrow material which is rolled into the slab. Therefore, the user is obliged to renew these rolls frequently, even though the other portions of the rolls are not worn. In consequence, the running and maintenance costs incurred when the narrow strips are rolled are several times as high as those incurred when the wide strips fully occupying the roll breadth are produced.

In order to improve the production efficiency of the steel sheet while reducing the installation cost by overcoming these problems, it is advisable to operate the equipment with strips having a large breadth and, in order to meet the demand, to split the same into the demanded sheet breadth at a step immediately before turned into final product, e.g. after the rolling by cold strip mill in the production of zinc-plated steel sheet.

Rolled steel sheet usually has a tapered edge referred to as "edge drop" along both side edges thereof. Namely, the rolling rolls, which have circular cross-sections are deformed under the reduction force to generate the edge drops at the boundary of contact between the roll and the steel sheet, i.e. at each side edge of the steel sheet. The edge drop is attributable also to a lateral or breadthwise plastic flow of the material during the rolling. The breadthwise plastic flow is heavy particularly in hot rolling. In some cases, the steel sheet having edge drops at both side edges is slitted by a known device such as a slit. In such a case, the slitted ends, i.e. the side edges or corners, of the slit sheets are naturally keen and the slit surfaces form a right angle to the plane of the slit sheets. When such a slit sheet having keen side edges is subjected to a plating with zinc, tin or the like, the flow of the plating solution is unsmooth at the keen edges of the sheet because the corners tend to be cooled rapidly. In consequence, the plating layer is expanded in the thicknesswise direction of the sheet along the side edges or corners to form an excessive layer generally referred to as "edge overcoat". The generation of the edge overcoat not only consumes the plating solution wastefully but the commercial value of the steel sheet product is deteriorated because the steel sheet coil undesirably has a frusto-conical shape due to the inflation at the portions where the edge overcoat is formed.

SUMMARY OF THE INVENTION

Accordingly, an object of the invention is to provide a method of and apparatus for effecting a slitting rolling of a steel sheet, improved to provide edge drops to the end surfaces of split steel sheets which are formed by slitting a wide steel sheet in the breadthwise direction.

Another object of the invention is to provide a method of and apparatus for effecting slitting rolling of a steel sheet, wherein no plating is conducted after slitting a wide steel sheet into narrower steel sheets so as to prevent generation of any edge overcoat at the split end surfaces of the slit sheets.

To these ends, according to the invention, there is provided a method of effecting slitting rolling of a steel sheet comprising: slitting a wide steel sheet in the breadthwise direction into a plurality of steel sheets of smaller breadths; moving the slit steel sheets in the breadthwise direction away from each other to form and maintain a predetermined distance between the slit steel sheets and effecting rolling on respective slit steel sheets in such a manner as to form edge drops on both breadthwise ends of each slit steel sheets.

DESCRIPTION OF THE PREFERRED EMBODIMENT

A steel sheet slitting rolling method and apparatus in accordance with a preferred embodiment of the invention will be described hereinunder with reference to the accompanying drawings.

Figure 1:
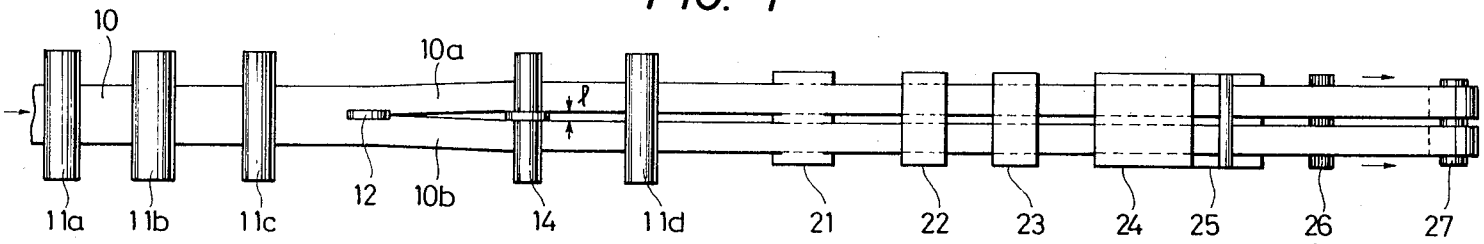
FIG. 1 is a plan view showing a general arrangement of a steel sheet slitting rolling apparatus in accordance with an embodiment of the invention.
Figure 2:
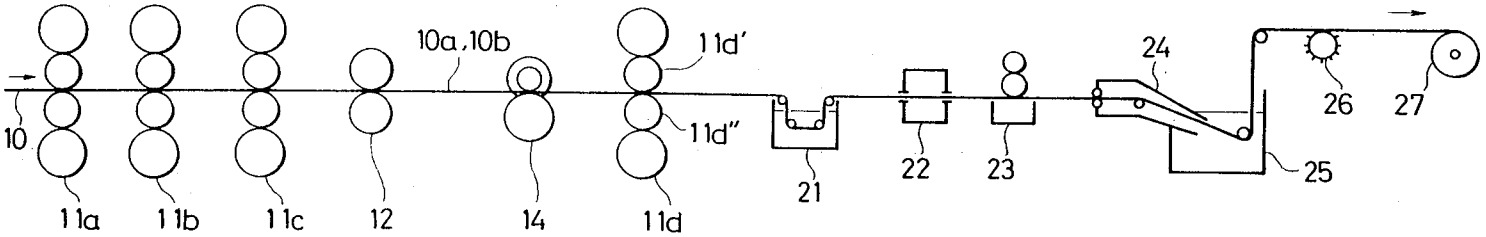
FIG. 2 is an elevation view of the apparatus shown in FIG. 1.

Referring first to FIGS. 1 and 2, a steel sheet 10 of a large breadth, which has been moved through a continuous slab casting apparatus (not shown) and a hot strip mill (not shown) is rolled through a plurality of rolling stands 11*a*, 11*b* and 11*c* which constitute Nos. 1,2 and 3 stands of a tandem rolling mill. The steel sheet 10 is then split in the breadthwise direction thereof into steel sheets 10*a* and 10*b* by a slitter 12 disposed at the outlet side of the No. 3 stand 11*c*. Then, the slit steel sheets 10*a* and 10*b* are moved laterally away from each other by a separator 14 which is disposed at the downstream side of the slitter 12 so that a distance l is formed between two slit sheets 10*a* and 10*b*. The slit steel sheets 10*a* and 10*b*, separated from each other by the distance l, are then rolled by a rolling stand 11*d* disposed at the downstream side of the slitter 12, so that edge drops are formed on both breadthwise ends of these steel sheets 10*a* and 10*b*. The steel, sheets provided at both side edges thereof with the edge drops, are then delivered to a plating process. More specifically, these steel sheets 10*a* and 10*b* are washed by a washing device 21 and then dried by a drying furnace 22. Subsequently, a plating prohibition layer is formed on the surface of each steel sheet which is not to be plated, by applying a prohibitor such as molybdenum disulfide to such surface by a roll coater 23. The steel sheets are then made to pass through a heating furnace 24 so as to print the prohibitor such as molybdenum desulfide and are then introduced into a plating bath 25 of, for example, zinc. Subsequently, the molybdenun disulfide layer is removed by a brushing roll 26 and, finally, the steel sheets are coiled by a coiler 27 as the plated steel sheet product.

Figure 3:
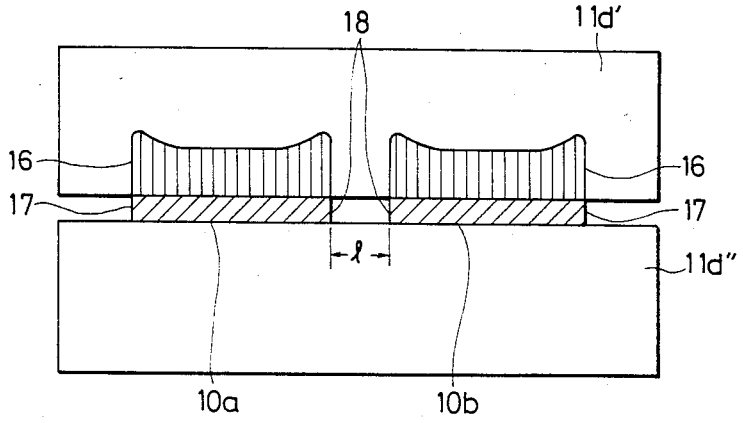
FIG. 3 shows the rolling pressure distribution along the breadth of a split steel sheet when the latter is rolled by the rolling apparatus of the invention.
Figure 4:
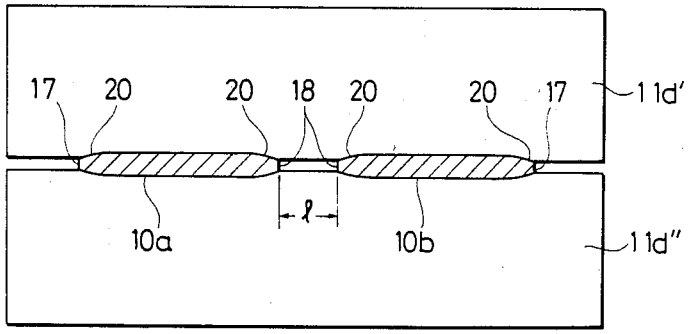
FIG. 4 illustrates a roll deflection as observed during the rolling of the slit sheet by the rolling apparatus of the invention.

FIGS. 3 and 4 show the state of operation of the No. 4 rolling stand 11*d* for rolling the steel sheets 10*a* and 10*b* which are formed by slitting the wide sheet 10 into breadths meeting the greatest demand. More specifically, this Figure shows in a partly-sectioned side elevation the rolling stand 11*d* having rolls 11*d*' and 11*d*'' for rolling the steel sheets 10*a* and 10*b*, respectively. According to the result of a simulation test conducted with a computer, it is possible to obtain such a rolling pressure distribution along the breadths of both steel sheets that the pressure is increased at each breadthwise end 17,18 of both steel sheets 10*a*, 10*b* as schematically shown in FIG. 3, provided that a predetermined distance l is preserved between the separated steel sheets. In other words, the rolling pressure can be increased even at the slit breadthwise ends 18 of both steel sheets 10*a* and 10*b*.

Consequently, therefore, the surfaces of the work rolls 11*d*' and 11*d*'' are deflected as illustrated in FIG. 4, so that the edge drops are formed not only at the outer breadthwise ends 17, i.e. the breadthwise ends before the slitting, but also at the breadthwise ends 18 formed as a result of the slitting.

FIG. 9 illustrates the state of change in the steel sheet to which the invention is applied. Namely, FIG. 9A shows the wide steel sheet 10 before the slitting. The steel sheet 10 is slitted into steel sheets 10*a*, 10*b* as shown in FIG. 9B by the slitter 12. FIG. 9C shows the slitted steel sheets 10*a* and 10*b* in the rolled state. It will be seen that edge drops 20 are formed on both breadthwise ends 17 and 18 of two steel sheets 10*a* and 10*b*. FIG. 9D shows the steel sheets 10*a* and 10*b*, having edge drops at both ends thereof, plated to have plating layers designated at a numeral 4. It will be seen from FIG. 9D that edge overcoat is avoided at each breadthwise end of each steel sheet.

Figure 10:
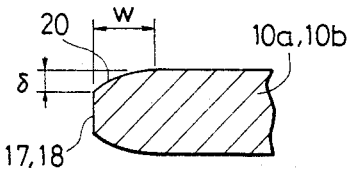
FIG. 10 is an illustration of the state of edge drop occurring in the breadthwise ends of the steel sheet.

As stated before, the slit steel sheets 10*a* and 10*b* are separated from each other by the separator 14 to preserve a distance l therebetween. An explanation will be made hereinunder as to the optimum distance l for creating sufficient edge drops at the breadthwise ends of respective steel sheets by rolling. Referring to FIG. 10 illustrating the shape of the edge drop 20, the shape of the edge drop appearing at each of the breadthwise ends 17, 18 of each steel sheet 10*a*, 10*b* can be expressed in terms of amount $\delta$ of edge drop in the thicknesswise direction of the sheet and the width w of the edge drop.

Figure 5:
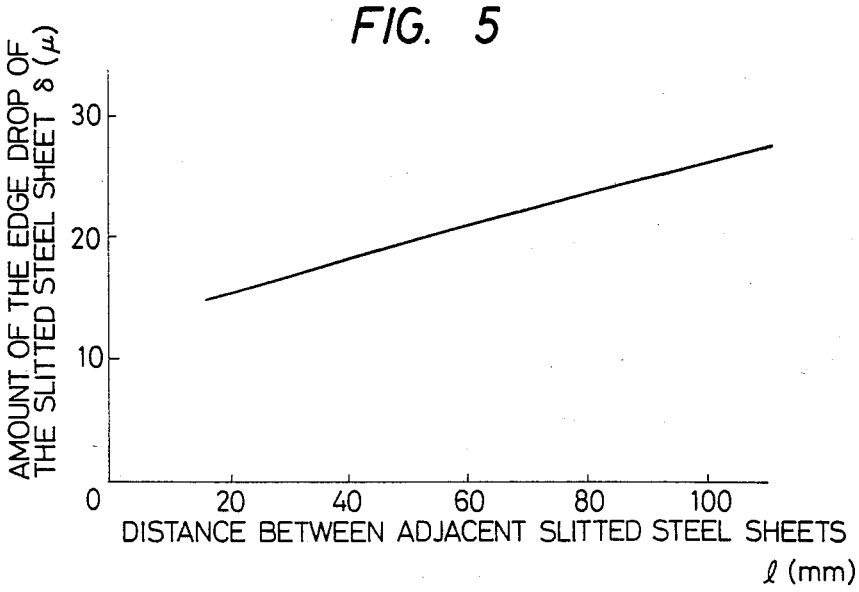
FIG. 5 is a diagram showing the relationship between the distance l preserved between adjacent slit sheets and the amount $\delta$ of edge drop, as obtained through an experiment.
Figure 6:
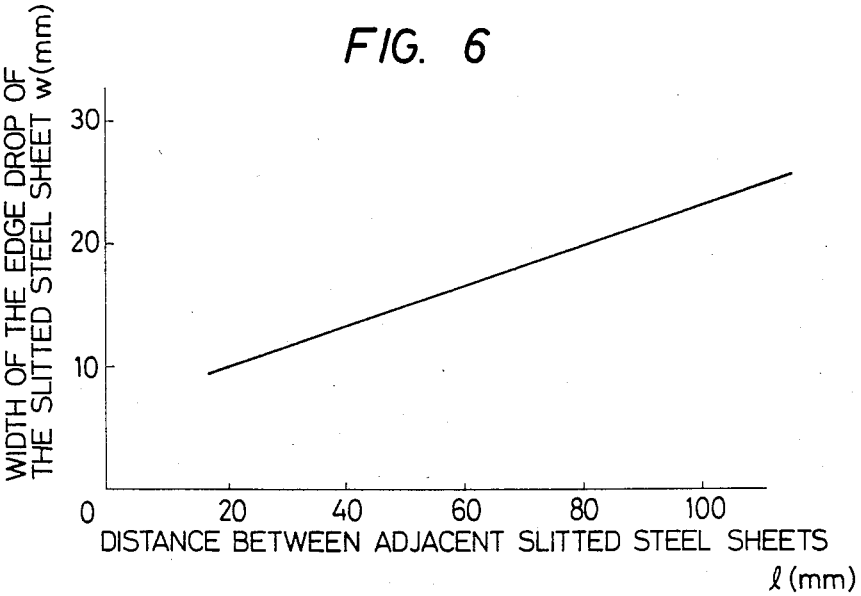
FIG. 6 is a diagram showing the relationship between the distance l between adjacent slit sheets and the width w of the edge drop of split steel sheet as obtained through an experiment.

FIG. 5 shows the result of the experimental rolling conducted with a work roll of 100 mm using a full hard material of 0.32 mm thick and 300 mm wide. In FIG. 5, the axis of abscissa represents the distance l between two slit steel sheets 10*a* and 10*b*, while the axis of ordinate represents the amount $\delta$ of the edge drop. FIG. 6 shows the result of the same experimental rolling in which the axis of ordinate represents the edge drop width w. The optimum values of the edge drop amount $\delta$ and edge drop width w are varied in accordance with the kind of plating. For instance, when the steel sheets are plated with zinc by dipping, it is necessary to satisfy the condition of $\delta > 15\mu$ and $w > 10$ mm. Therefore, as will be understood from FIGS. 5 and 6 , it is necessary to select the distance l not smaller than 20 mm, in order to satisfy the required shape of edge drop, i.e. the factors $\delta$ and w. Therefore, the separator 14 should be designed and constructed to move the slit steel sheets 10*a* and 10*b* in the breadthwise direction more than a distance l not smaller than 20 mm away from each other.

Figure 7:
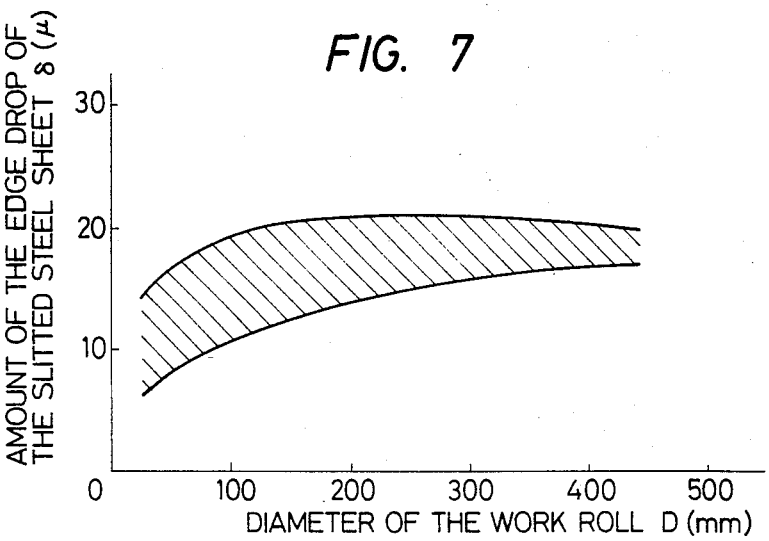
FIG. 7 is a chart showing the relationship between the diameter D of the work roll and the amount $\delta$ of the edge drop in the rolled slit sheet as obtained through a calculation.
Figure 8:
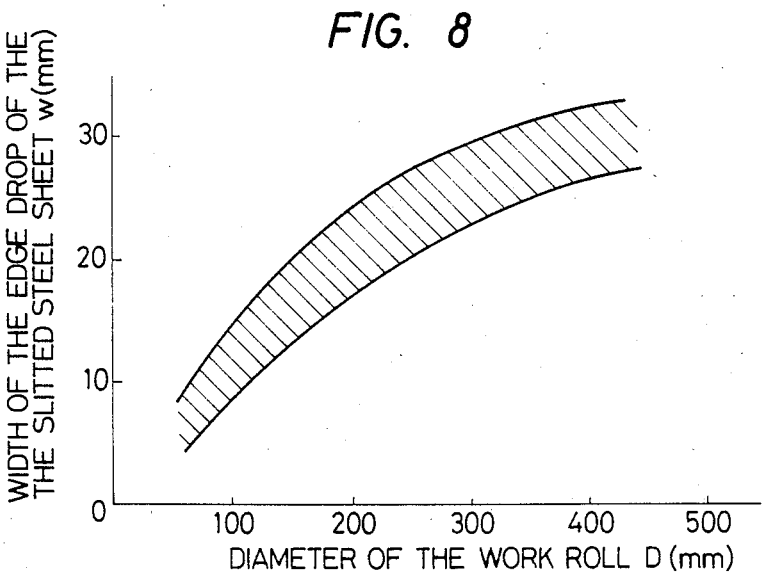
FIG. 8 is a diagram showing the relationship between the work roll diameter D and the edge drop width w in the rolled slit sheet as obtained through a calculation.
Figure 9A:
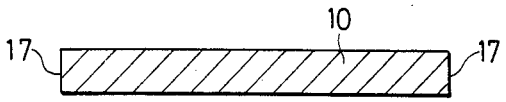
FIGS. 9*a*–9*d* illustrate the state of change in the steel sheet to which the invention is applied.
Figure 9B:
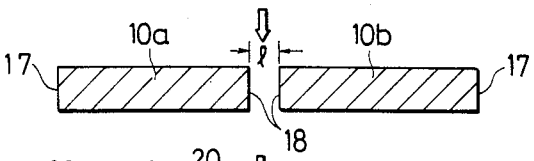
Figure 9C:
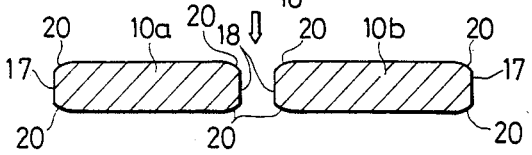
Figure 9D:
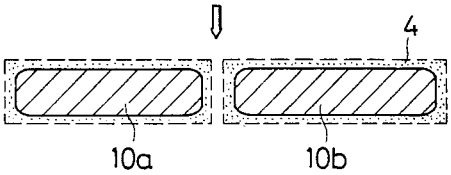

FIG. 7 shows the relationship between the diameter of work roll 11*d* (axis of abscissa) and the amount $\delta$ of edge drop (axis of ordinate) as obtained through a calculation by a computer, while FIG. 8 shows the relationship between the work roll diameter and the edge drop width w. In the calculation for obtaining the relationships shown in FIGS. 7 and 8, it is assumed that two slit steel sheets 10*a* and 10*b* are rolled in parallel and that a full hard material is used as the rolled material. The distance l between two slit sheets 10*a* and 10*b* was selected to be 30 mm. It is assumed also that the reduction ratio of the work roll is 31.3% and that the deformation resistance km of the material is 72 to 80 $Kg/mm^2$.

The values of the factors $\delta$ and w of edge drop as located in the curves in FIGS. 7 and 8 when the work roll diameter is 100 mm well conform with those in the experimental values shown in FIGS. 5 and 6. This shows that this calculation is quite adequate.

In the embodiment described hereinbefore, the shape of the edge drop is changed by varying the distance l between two slit steel sheets 10*a* and 10*b* and the work roll diameter. The edge drops, however, may be varied by varying other factors such as amount of reduction of the rolling roll, roll bending force and so forth.

Needless to say, the slitter 12 and the separator 14 need not always be positioned at the inlet side of the final stand 11*d* of the tandem rolling stands 11*a* to 11*d*, but may be disposed at the inlet side of the upstream stand such as the stand 11*c* or 11*b*.

As will be understood from the foregoing description, according to the invention, a wide steel sheet is slit in the breadthwise direction into a plurality of sheets and the rolling is conducted on the slit steel sheets.

Consequently, the steel sheets are rolled in such a form as to have edge drops at both breadthwise ends thereof. Thanks to the formation of the edge drops at both breadthwise ends, it is possible to avoid the undesirable formation of edge overcoat at both breadthwise ends of each steel sheet and, hence, to obtain plated steel sheets of a distinguished quality.

What is claimed is:

1. A method of effecting a slitting rolling on a steel sheet comprising the steps of:

(a) slitting a wide steel sheet in the breadthwise direction thereof;

(b) thereafter moving the slit steel sheets away from each other in the breadthwise direction and in a common plane to form and maintain a predetermined spacing distance between the adjacent slit steel sheets;

(c) thereafter effecting rolling on each slit steel sheet while maintaining the spacing between the coplanar sheets sufficiently to form edge drops on both breadthwise ends of each said slit steel sheet; and (d) thereafter plating each slit steel sheet including plating the edge drop areas to thereby avoid edge overcoat.

2. A method according to claim 1, wherein said step of rolling rolls by a tandem rolling mill having a plurality of rolling stands, and the step of slitting said wide steel sheet in the breadthwise direction is conducted at the upstream side of the final stand of said tandem rolling mill.

3. A method according to claim 1, wherein said step of moving provides the predetermined distance between adjacent slit steel sheets not smaller than about 20 mm.

4. A method according to claim 3, wherein said step of moving provides the distance formed between the slit steel sheets not smaller than about 20 mm.

5. A method according to claim 1, wherein said rolling rolls by a tandem rolling mill having a plurality of rolling stands, and said step of slitting said wide steel sheet in the breadthwise direction is conducted between at least two of said rolling stands; said step of plating being conducted to plate said slit steel sheets, after they have been rolled by said step of rolling, with a plating material been including zinc; and said step of moving further maintaining a distance between adjacent slit steel sheets during subsequent rolling at least greater than 20 mm.

6. A method according to claim 1, wherein said rolling rolls by a tandem rolling mill having a plurality of rolling stands, and said step of slitting said wide steel sheet in the breadthwise direction is conducted between at least two of said rolling stands; said step of plating being conducted to plate said slit steel sheets, after they have been rolled by said step of rolling, with a plating material including zinc; and said step of moving providing a distance between adjacent slit steel sheets sufficient to obtain an amount of edge drop greater than $15\mu$, and a width of edge drop greater than 10 mm, for all breadthwise edges of said slit sheets during subsequent rolling and prior to said step of plating.

7. An apparatus for effecting slitting rolling of a steel sheet, comprising:

slitting means for slitting a wide steel sheet in the breadthwise direction thereof;

separating means disposed between the adjacent slit steel sheets for moving said slit steel sheets in the breadthwise direction away from each other in a common plane to form and maintain a predetermined spacing distance between adjacent slit steel sheets;

a rolling mill stand downstream from said slitting means and separating means, having means to effect reduction rolling on respective coplanar slitt steel sheets spaced from each other by said predetermined distance;

said separating means and said rolling means combining their functions for forming edge drops on both breadthwise ends of each of the slit steel sheets; and plating means for plating said slit steel sheets with said edge drops to avoid edge overcoat.

8. An apparatus according to claim 7, wherein said rolling mill is a tandem rolling mill having a plurality of rolling stands, said slitting means and said separating means being disposed at the upstream side of the final stand of said tandem rolling mill.

9. The apparatus of claim 7, wherein said rolling mill stand has a cylindrical upper work roll and a cylindrical lower work roll that directly contact said slitted steel sheets.

* * * * *